United States Patent [19]

Nomura

[11] 4,280,208

[45] Jul. 21, 1981

[54] ELECTRONIC TIMEPIECE

[75] Inventor: Yasushi Nomura, Tokorozawa, Japan

[73] Assignee: Citizen Watch Co., Ltd., Tokyo, Japan

[21] Appl. No.: 927,445

[22] Filed: Jul. 24, 1978

[30] Foreign Application Priority Data

| | | | |
|---|---|---|---|
| Jul. 29, 1977 | [JP] | Japan | 52/90987 |
| Aug. 16, 1977 | [JP] | Japan | 52/98108 |
| Sep. 5, 1977 | [JP] | Japan | 52/106412 |
| Sep. 12, 1977 | [JP] | Japan | 52/108765 |
| Sep. 19, 1977 | [JP] | Japan | 52/112364 |

[51] Int. Cl.[3] ..... G04B 1/26

[52] U.S. Cl. ..... 368/66; 368/73; 368/203; 368/204

[58] Field of Search ..... 368/66, 73, 203, 204

[56] References Cited

U.S. PATENT DOCUMENTS

| | | | |
|---|---|---|---|
| 3,745,761 | 7/1973 | Tsuruishi | 368/73 |
| 3,894,278 | 7/1975 | Gerum | 368/66 |
| 3,991,553 | 11/1976 | Bergey et al. | 368/66 |
| 4,014,164 | 3/1977 | Fujita | 368/66 |
| 4,129,981 | 12/1978 | Nomura et al. | 368/204 X |
| 4,175,377 | 11/1979 | Ichikawa | 368/66 |

*Primary Examiner*—Ulysses Weldon

*Attorney, Agent, or Firm*—Jordan and Hamburg

[57] ABSTRACT

An electronic timepiece having a battery lifetime detection mechanism is provided with a control circuit and external operation member the suitable manipulation of which permits a battery lifetime warning indication, produced in response to a signal from the detection mechanism, to be temporarily displayed in the normal time display mode, transferred to an permanently displayed in another display mode, or converted to an audible warning tone if suitable acoustic means are provided.

18 Claims, 15 Drawing Figures

ELECTRONIC TIMEPIECE

This invention relates to an electronic timepiece equipped with a mechanism which detects the fact that a battery is nearing the end of its life.

In conventional electronic timepieces equipped with a mechanism for detecting the end of battery lifetime, a warning display to indicate this fact was effected by causing a normal time display to change in appearance upon a signal from the detection mechanism. In a timepiece with an analog type display the warning indication could be effected in one of two ways. In one approach, the analog timepiece was provided with a light emitting element which served as a warning display when caused to flicker as the battery neared the end of its useful life. In the other approach, the advance of the timpiece hands was caused to change to give the warning indication. For example, upon detecting the end of the battery lifetime, a second hand which normally advanced at a rate of one second graduation per second was caused to advance by two second graduations instead of one. In a digital timepiece equipped with an electro-optic display device making use of liquid crystals or the like, the warning indication could be attained by causing the entire surface of the display to flicker.

In accordance with each of these conventional systems the warning display once activated remained in the activated state until a new battery was exchanged for the old one. In the analog timepiece equipped with the light emitting element a typical structure had the element ignite once per minute during normal operation and flicker continuously when so directed by the battery lifetime detection mechanism. A similar disadvantage is found in the analog timepiece with the altered hand movement since the modified hand advance as an indication of battery lifetime continued uninterrupted until the battery was replaced. The same is true of the digital display using an electro-optic device.

The obvious shortcomings of these conventional systems in which the warning display remains in the activated state are higher power consumption in the case of the flickering display and the needless permanent disturbance of hand movement in the case of the analog display. These systems, although they do urge a user to rapidly replace the battery, are therefore wasteful and inconvenient since the user who does not intend to immediately replace the battery upon confirmation of the warning display cannot turn off the warning indication and restore the timepiece display to its original state. Moreover, while it may be possible to conceive of the provision of a simple external control member that could be adapted to remove the warning display and restore the original display, there is always the danger that the warning indication will be forgotten once the restoration has been made.

There is thus a need for a battery lifetime warning display which will be activated temporarily instead of remaining in the activated state continuously until replacement of the battery. This would eliminate wasteful usage of battery power and, in the case of an analog timepiece, make it possible to do away with the second hand and still provide a warning indication. This in turn would provide a thin, fashionable timepiece with a simplified display consisting of only two hands. Although a conventional two-hand analog timepiece could provide the warning display merely by adopting a light emitting element, the inclusion of this element would detract from the simple appearance of the timepiece. On the other hand, eliminating the light emitting element in the absence of a second hand would mean continuously advancing the minute hand two graduations instead of one to provide the warning indication. Although feasible this would obviously make it difficult to maintain the correct time.

It is therefore an object of the present invention to provide an electronic timepiece having a battery lifetime detection mechanism in which a battery lifetime warning display produced in response to a detection signal from the detection mechanism does not permanently appear in the normal time display mode of the timepiece.

It is another object of the present invention to provide an electronic timepiece having a battery lifetime detection mechanism in which a warning display produced in response to a detection signal from the detection mechanism can be deactivated by the user upon confirmation thereof, but where the deactivated state is overcome after a predetermined period of time or at a specific time to permit a periodic restoration of the warning display and thus remind the user to replace the battery.

It is another object of the present invention to provide a two-hand analog electronic timepiece having a battery lifetime detection mechanism in which the advance of the timepiece hands is altered by the detection mechanism only temporarily upon a prescribed instruction to provide a battery lifetime warning display.

It is still another object of the present invention to provide a digital electronic timepiece having a battery lifetime detection mechanism and equipped with an electro-optic display device, in which a warning indication from the detection mechanism can be shifted to and displayed in another display mode by manipulating an external operation member after the warning indication has been displayed in the normal time display mode.

It is still another object of the present invention to provide an electronic timepiece having a battery lifetime detection mechanism in which a warning indication from the detection mechanism is not displayed in the normal time display mode of the timepiece but only in another frequently used timepiece mode.

It is a further object of the present invention to provide an electronic timepiece having a battery lifetime detection mechanism and equipped with an acoustic alarm device which generates a battery lifetime warning tone in response to a detection signal from the detection mechanism only at a specific time, which tone differs from that emitted during normal timepiece operation.

Briefly stated, an electronic timepiece in accordance with the present invention has a battery lifetime detection mechanism and is provided with a control circuit responsive to an external operation mechanism the suitable operation of which regulates the term of a battery lifetime warning display generated when the battery lifetime detection mechanism delivers a detection signal.

According to a further feature of the present invention, an acoustic alarm device issues a distinctive tone indicative of a battery lifetime warning in response to a signal which is the logical product of the battery lifetime detection signal obtained from the detection mechanism and a specific time signal obtained from the timekeeping circuitry of the timepiece.

In still another aspect of the present invention, a digital electronic timepiece equipped with a plurality of display modes including a normal time display mode is provided with a battery lifetime detection mechanism that provides a warning indication which is displayed in the normal time display mode until the manipulation of an external control member transfers the warning indication to another display mode where it is displayed until the battery is replaced.

Other objects, features and advantages of the present invention will become apparent from the following detailed description taken in conjunction with the accompanying drawings, in which.

Figure 1:
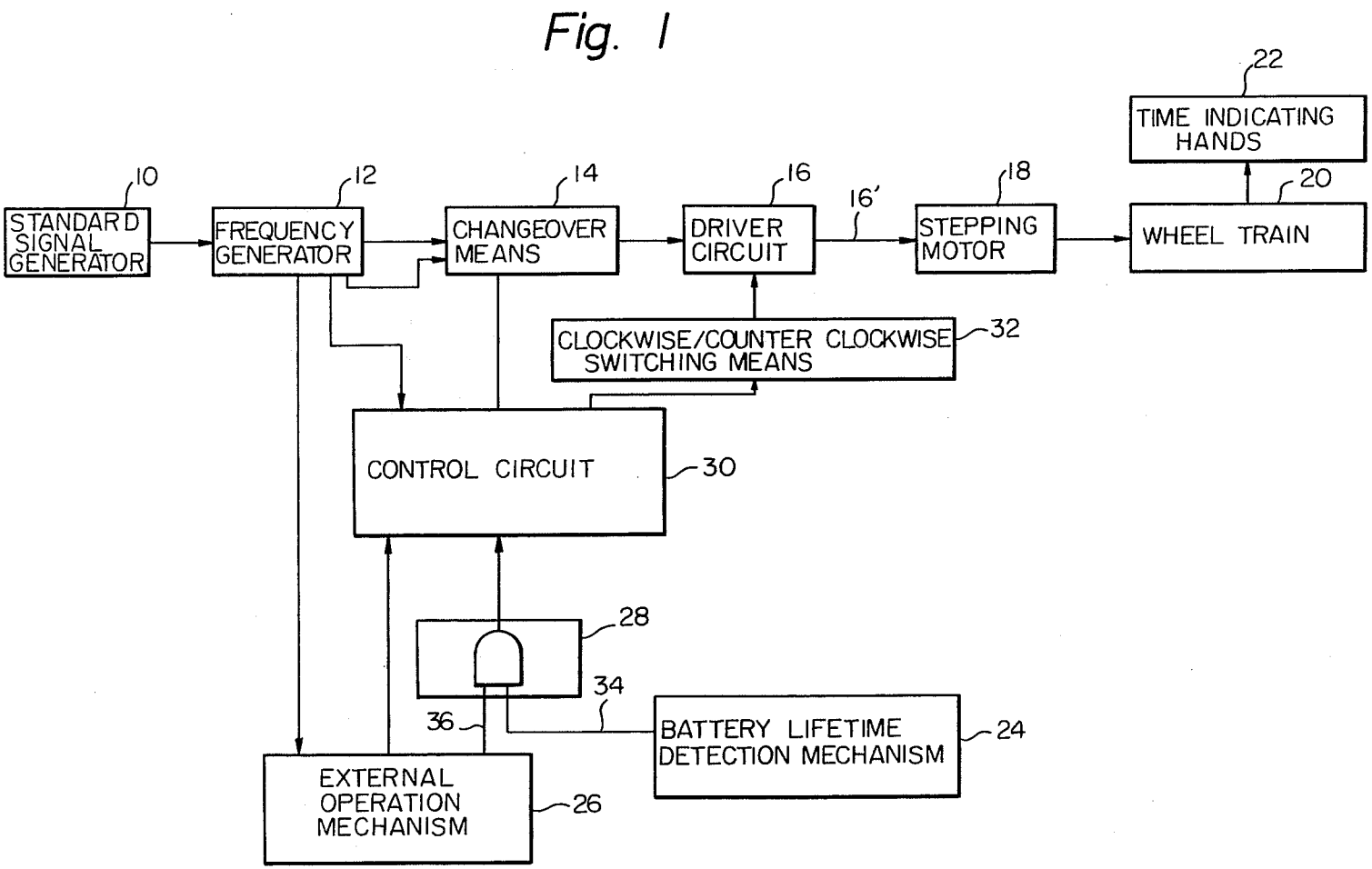
FIG. 1 is a simplified block diagram of a first embodiment of an electronic timepiece according to the present invention.

Referring now to FIG. 1, reference numeral 10 denotes a standard signal generator, 12 a frequency divider, 14 changeover means, 16 a driver circuit, 18 a stepping motor, 20 a wheel train, 22 time indicating hands, 24 a battery lifetime detection mechanism, 26 an external operation mechanism, 28 an enabling gate circuit, 30 a control circuit, and 32 clockwise/counter-clockwise switching means.

During ordinary operation, the standard signal generator 10 produces a relatively high frequency signal, which is divided down to a relative low time unit signal of 1 Hz clock pulses by frequency divider 12. The time unit signal is applied to driver circuit 16 which produces driving pulses that rotate stepping motor 18 in the clockwise direction. The stepping motor 18 in turn acts through the wheel train 20 to drive the time indicating hands 22 which may comprise, for example, hours, and minutes hands. When battery lifetime detection mechanism 24 detects a drop in battery voltage below a predetermined value and generates a detection signal which appears on line 34, with the line 34 attaining a high or logic "1" level. If, in this case, external operation mechanism 26 is operated, line 36 will rise to a logic "1" level. Under these conditions, control circuit 30 generates a control signal, which is applied to changeover means 14 which allows a high speed signal, higher in frequency than the time unit signal, from frequency divider 12 to driver circuit 16. The control circuit 30 further generates a second control signal by which clockwise/counter-clockwise switching means 32 is controlled so as to cause the driver circuit 16 to produce second driving pulses in response to the high speed signal from divider 12. The stepping motor 18 is driven at high speed in the counter-clockwise direction in response to the second driving pulses signal delivered from driver circuit 16. After stepping motor 18 and hence time indicating hands 22 rotate counter-clockwise at a higher than normal speed for a predetermined time period, control circuit 30 automatically operates clockwise/counter-clockwise switching means 32 that now permits driver circuit 16 to produce third driving pulses in response to the high speed signal from frequency divider 12. In this case, the stepping motor 18 drives through wheel train 20 the time indicating hands 22 clockwise at a higher than normal speed.

In view of the time intervals required for the high speed counter-clockwise and clockwise rotations of the time indicating hands 22, the control circuit 30 controls the changeover means 14 and switching means 32 such that the driver circuit 16 produces the third driving pulses for a prescribed time period whereby the high speed advance of the time indicating hands in the clockwise direction continues until the time delay caused by the altered hand movement has been compensated. Once this compensation has been accomplished, control circuit 30 generates a third control signal which causes changeover means 14 to pass the normal time unit signal to driver circuit 16. Thus, the driver circuit 16 generates normal driving pulses once again by which stepping motor 18 rotates the hands 22 in normal fashion. It will thus be seen that control circuit 30 is rendered operative in response to the detection signal from battery lifetime detection mechanism 24 only when external operation mechanism 26 is actuated. In the present embodiment, a warning display indicative of the approaching end to the life of the battery is effected by combining the high speed clockwise and counter-clockwise movements of the time indicating hands 22. This may be attained, even if only a minutes hand and hours hand are provided, by causing one of the hands to rotate counter-clockwise and then clockwise in rapid fashion through increments of several minute graduations or through several 10-minute graduations.

In prior art timepieces, a modulated advancement of the time indicating hands continues until replacement of the battery. Since modulated hand movement through increments of several minute graduations or 10-minute graduations upon a command from the battery lifetime detection mechanism makes it difficult or impossible to simultaneously maintain a display of the timekeeping function, it is in practice not possible to obtain the battery lifetime warning display through modulation of hand movement in a timepiece having only a minutes and hours hand.

The external operation member in the present invention if installed in addition to already existing members of this type in order to provide the warning display would pose difficulties in view of the limited space in an electronic timepiece, particularly one which is portable. The present invention therefore adopts a structure that makes joint use of already existing external operation members provided to control other timepiece functions such as time corrections. This structure allows the battery lifetime warning display to be controlled by these existing operation members without detracting from these other functions or ease of use.

Figure 2:
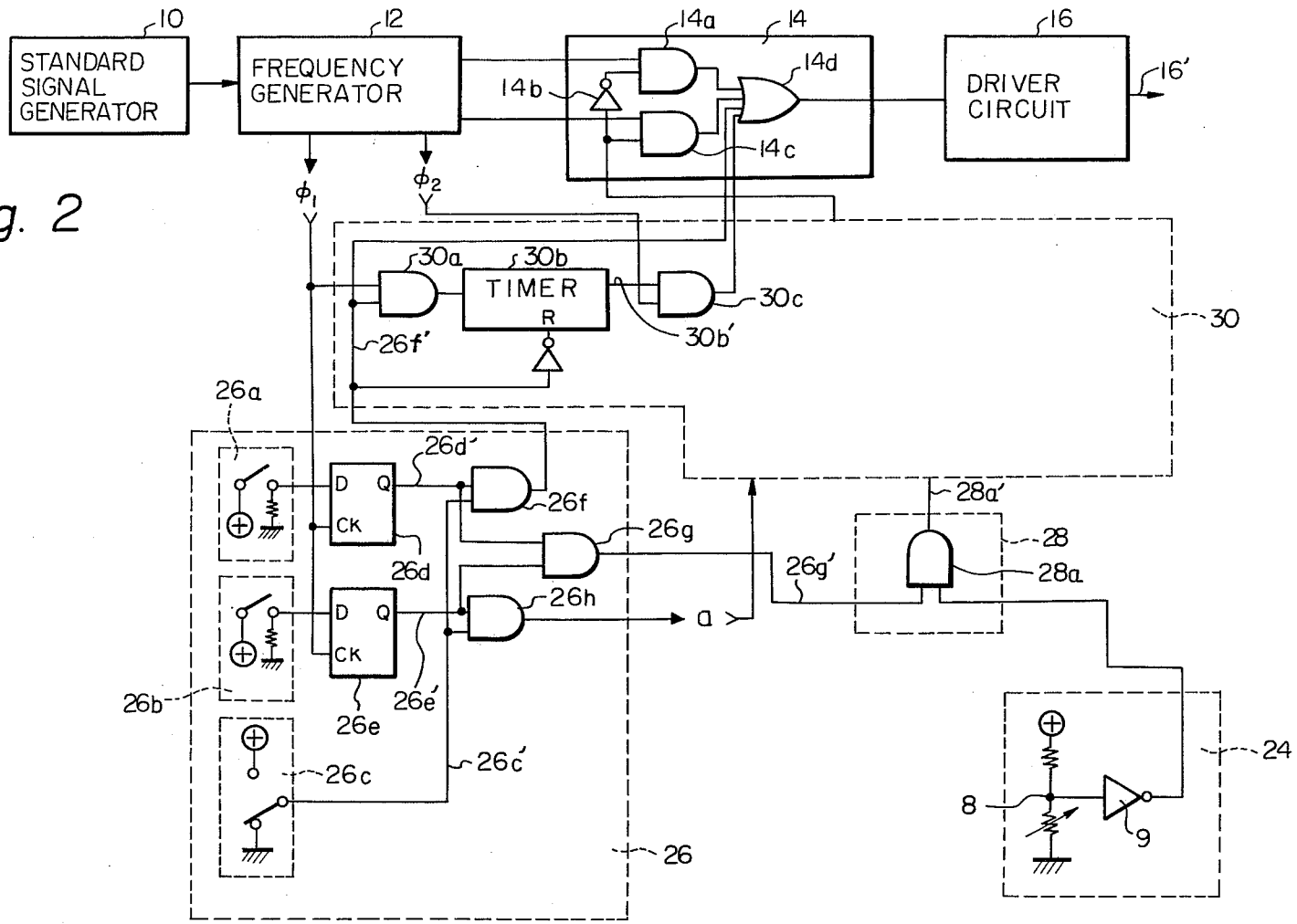
FIG. 2 is a block and logic diagram showing a detailed view primarily of the external operation mechanism depicted in FIG. 1.

FIG. 2 shows a more detailed circuitry for the timepiece shown in FIG. 1. In FIG. 2, the external operation mechanism 26 is shown as comprising a second switch member 26a for effecting both a manual advance and a high speed advance of time indicating hands, a second switch member 26b for clockwise and counter-clockwise rotation, and a third switch member 26c serving as a lock switch.

During normal operation, lock switch 26c is held in its electrically locked condition, i.e., connected to a low potential side of a battery. Under this condition, AND gates 26f and 26g are inhibited so that no output is produced by AND gates 26f and 26g even if switch member 26a or 26b is inadvertently actuated. When it is desired to effect time correction, the switch member 26c is brought into contact with the high potential side of the battery to produce an electrically unlocked signal on lead 26'c, thereby opening AND gates 26f and 26h. Under these conditions, each time switch member 26b is operated a corresponding switching signal indicative of the number of operations appears on output line 26e' of flip-flop 26e. The AND gate 26h is responsive to the switching signal and the unlocked signal to produce an output signal a to allow switching between clockwise and counter-clockwise rotations of the time indicating hands in a manner as will be subsequently described. When switch member 26a is closed, flip-flop 26d produce a switching signal which appears on lead 26d'. AND gate 26f is responsive to the switching signal on lead 26d' and unlock signal on lead 26'c and produces an output signal appearing on line 26f' hereby opening AND gate 30a forming part of control circuit 30. A clock signal $\phi_1$ from frequency divider 12 is applied to timer 30b which opens AND gate 30c after a predetermined period of time. A second clock signal $\phi_2$ lower in frequency than the first clock signal $\phi_1$ is thereby permitted through an OR gate 14d of changeover means 14 to driver circuit 16 which generates high speed driving pulses to cause the stepping motor to perform a high speed correction of the time. However, if switch member 26a is operated a number of times within the predetermined time period established in timer 30b, a signal indicative of each such operation enters OR gate 14d through line 26f', thus permitting the time to be corrected manually. Lock switch member 26c when brought into contact with the low potential side of the battery causes AND gates 26f, 26h and thus overrides switch members 26a, 26b. However, if these switch members 26a, 26b are now operated simultaneously, lines 26d', 26e' go to logic "1" whereupon an identical level appears on output line 26g' of AND gate 26g. This opens AND gate 28a of gate circuit 28 so that a detection signal from the detection mechanism 24 may now enter control circuit 30.

Figure 3:
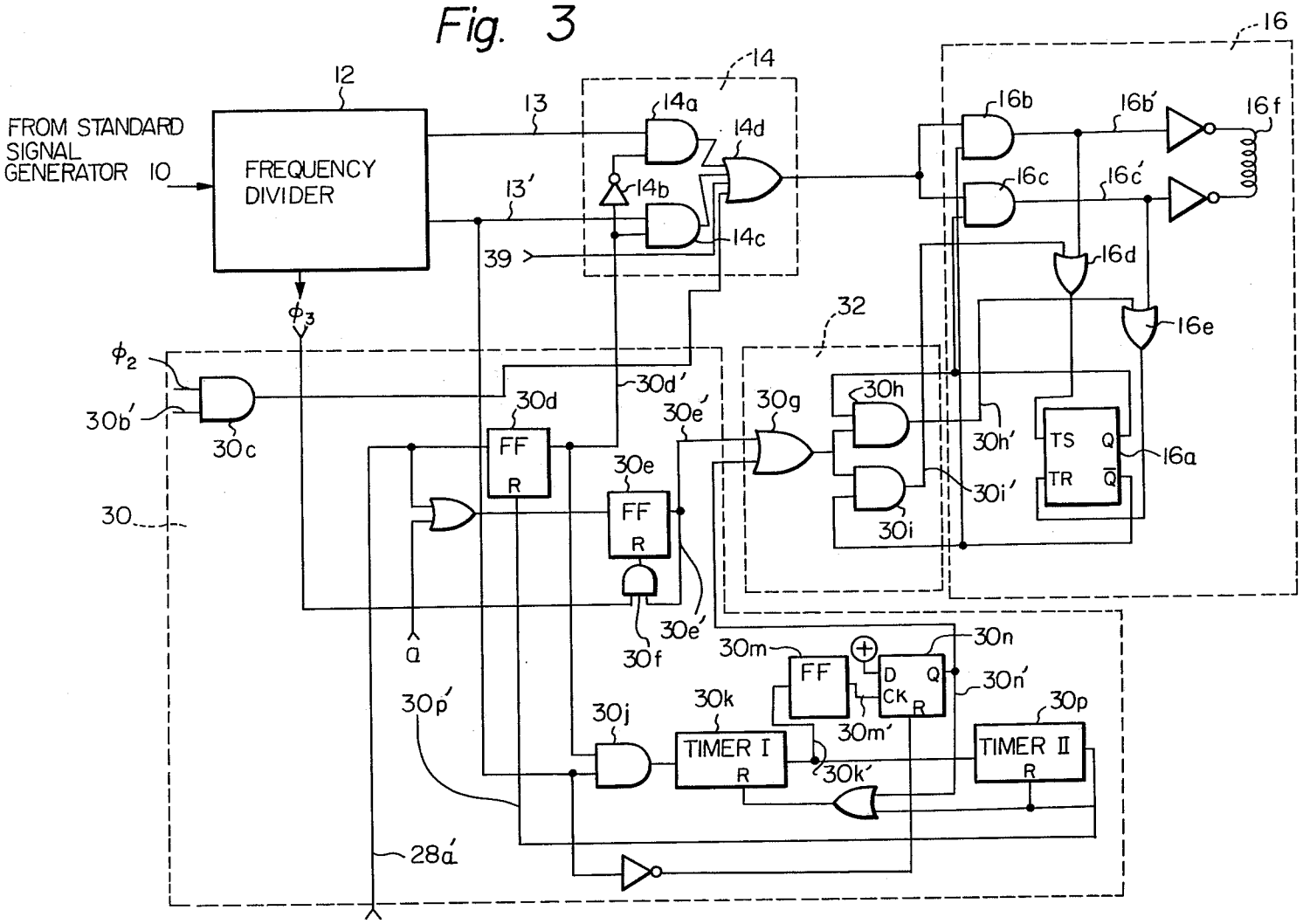
FIG. 3 is a logic diagram showing a more detailed view primarily of the control circuit depicted in FIGS. 1 and 2.

A more detailed view of this control circuit is shown in FIG. 3. In the normal operating state, 1 Hz clock pulses are applied from frequency divider 12 to driver circuit 16 through line 13 and changeover means 14. A trigger-set/reset type flip-flop 16a of driver circuit 16 is controlled by the clock pulses appearing at the output lines 16b', 16c' of respective AND gates 16b, 16c of the driver circuit. When the clock pulses appear on output line 16b' are applied to the set input terminal of flip-flop 16a through OR gate 16d, the Q output of the flip-flop 16a attains a logic "1" level in synchronism with the falling portion of the clock pulse. AND gate 16c thus opens while the $\overline{Q}$ output of the flip-flop 16a closes AND gate 16b since this particular output is at logic "0". The next pulse in the clock signal pulse train therefore appears on output line 16c' via AND gate 16c. This signal is now passed by OR gate 16e and enters the reset input terminal of flip-flop 16a where the Q output goes to logic "0" and the $\overline{Q}$ output to logic "1" in synchronism with the decaying portion of the clock pulse. AND gate 16b now opens and AND gate 16c closes. Accordingly, the next pulse in the clock signal pulse train appears on output line 16b'. Pulses are thus made to appear alternatingly on output lines 16b', 16c' so that an alternating drive current flows through a driving coil 16f of the stepping motor 18.

Meanwhile with respect to gate circuit 28 shown in FIG. 2, logic "1" on output line 28a' will cause the output lines 30d', 30e' of flip-flops 30d, 30e to attain the logic "1" level. The "1" logic on line 30d' closes AND gate 14a of changeover means 14 and opens AND gate 14c so that a high frequency signal from frequency divider 12 is applied through changeover means 14 to driver circuit. At the same time, the output of flip-flop 30e goes to logic "1", and AND gate 30f opens and flip-flop 30e is immediately reset by a clock signal $\phi_3$ delivered from frequency divider 12. A narrow pulse therefore appears on output line 30e' and is applied to clockwise/counter-clockwise switching means 32 where the pulse is passed by OR gate 30g and either AND gate 30h or 30i, depending on which one is open. The pulse will thus appear at either of the respective output lines 30h', 30i'.

AND gates 30h, 30i are adapted to open when a logic "1" level appears at, respectively, the $\overline{Q}$ and Q outputs of flip-flop 16a of driver circuit 16. When the pulse appears on output line 30h' it is applied to the reset input of flip-flop 16a through OR gate 16e so that the Q output is changed to logic "0" and the $\overline{Q}$ output to logic "1" in synchronism with the decaying portion of the pulse. The Q and $\overline{Q}$ outputs of the flip-flop are again restored to their respective logic "1" and "0" levels when the pulse appears on output line 30i' and is applied to the set terminal of the flip-flop through OR gate 16d. In other words, the output states of flip-flop 16a are caused to reverse. Accordingly, since the gating of AND gates 16b, 16c is also reversed as controlled by the output states of flip-flop 16a, a continuous train of pulses will appear on whichever of lines 16b', 16c has applied the last pulse delivered during normal operation. This pulse train therefore rotates the stepping motor in the reverse direction at a higher than normal speed. Meanwhile, the logic "1" which appears on output line 30d' and opens AND gate 30j so that the high frequency signal delivered on line 13' is also applied to timer 30k of control circuit 30.

The output line 30k' of timer 30k changes from logic "0" to logic "1" after a predetermined period of time, whereupon the output on line 30m' of flip-flop 30m changes from logic "0" to logic "1" causing a narrow pulse to appear on output line 30n' of flip-flop 30n. This signal is transmitted to clockwise/counter-clockwise switching means 32 and is then applied to the driver circuit 16 in the same manner as the pulse which appeared on output line 30e'. The stepping motor which had been rotating in the counter-clockwise direction at the higher speed is now rotated clockwise at a higher than normal speed as driven by the driver circuit 16.

Timer 30*k* is reset when the narrow pulse appears on output line 30*n*′ and again begins to count. At the instant that the passage of time as measured by the timer 30*k* is indicative of the time which was required for the reversal in rotation, the output line 30*k*′ of the timer 30*k* changes from logic "0" to logic "1". Now, however, output line 30*m*′ of flip-flop 30*m* is at logic "1" so that the line is returned to its former logic "0" level. Flip-flop 30*n* therefore does not produce the narrow pulse. As a result, timer 30*p* begins counting responsive to the high frequency signal which it receives on line 13′ and continues counting until compensation has been made for the time delay corresponding to the counter-clockwise and clockwise high speed rotative operations, whereupon the timer output line 30*p*′ changes from logic "0" to logic "1". This resets flip-flop 30*d*, returns output line 30*d*′ from a logic "1" to a logic "0" level, opens AND gate 14*a* of changeover means 14′ and closes AND gate 14*c*, thereby blocking the high frequency signal for clockwise rotation and returning the timepiece to the normal operating mode. Timers 30*k* and 30*p* are reset by the logic "1" on output line 30*p*′.

With this arrangement, the battery lifetime warning display is enabled only when the external operation mechanism 26 is operated in a specific manner. Moreover, the warning display is automatically deactivated and the timepiece returned to the normal display mode while maintaining the correct time. This feature allows a timepiece to be provided with a battery lifetime warning display that neither consumes excessive power nor permanently disrupts the display of time. The invention can thus be advantageously applied to a two-hand analog timepiece in which the time indicating mechanism can be made to rotate rapidly first in the counter-clockwise direction and then in the clockwise direction as in the foregoing embodiment, or first in the clockwise direction and then in the counter-clockwise direction. If a second hand is provided, the warning indication can be attained by causing the second hand to move through predetermined increments of, for example, 10 second graduations.

It is also possible to apply the present invention to a timepiece equipped with a light emitting diode or an alarm mechanism. The operation of the LED would be modulated such that the LED would flash to give the warning indication before being automatically deactivated. The alarm mechanism could be adapted to issue a tone indicative of a warning whenever both of the operation switches in FIG. 2 are depressed simultaneously. Of course in this case the battery lifetime warning would take the form of an audible signal rather than a visual display.

Figure 4:
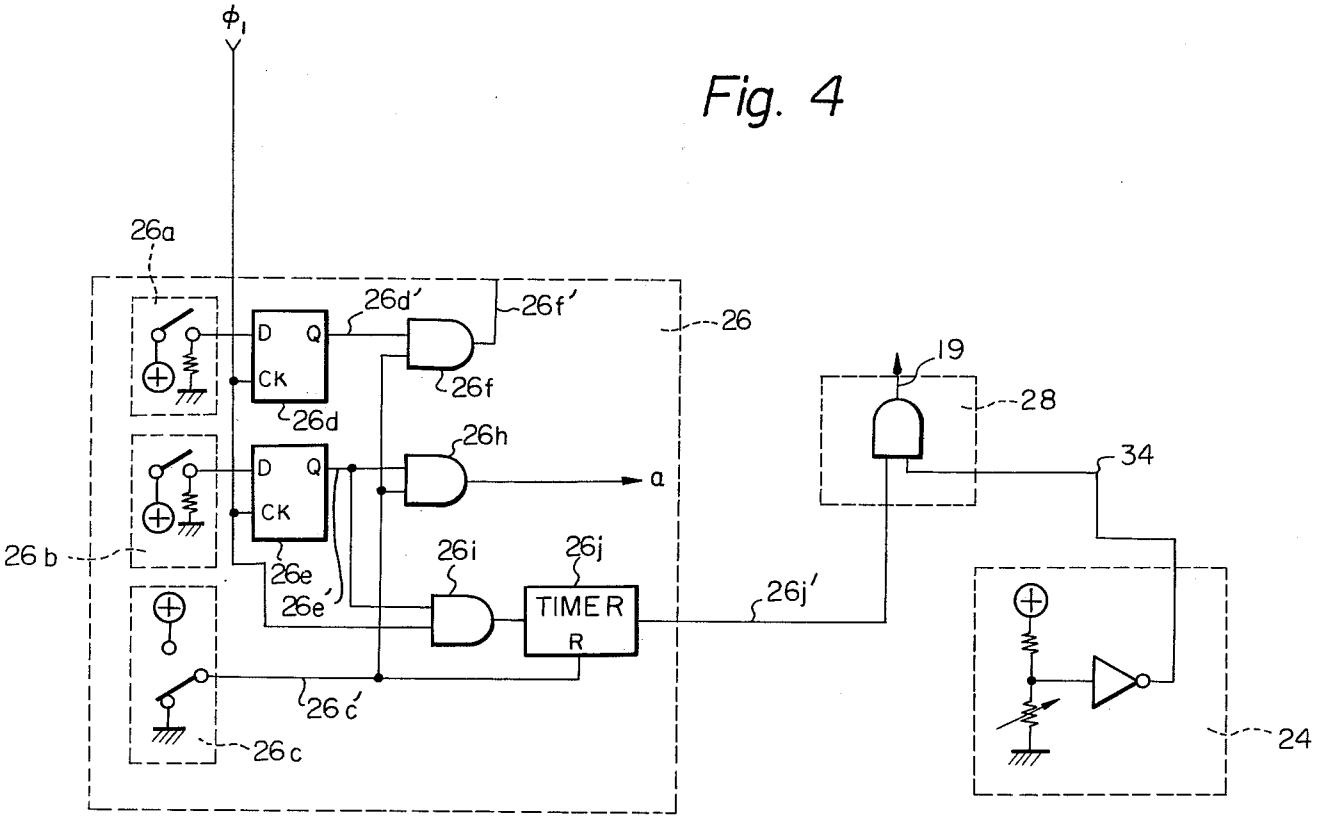
FIGS. 4 and 5 are other examples of the external operation mechanism.
Figure 5:
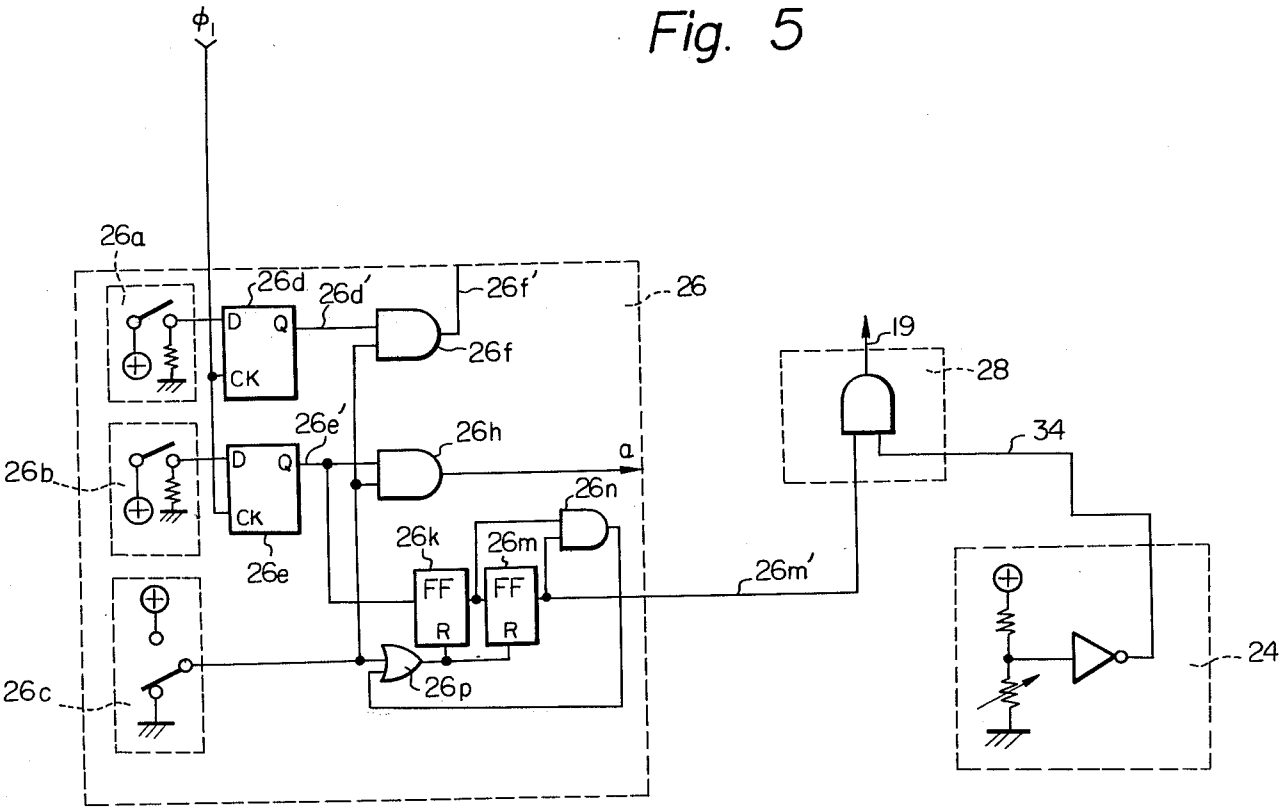

One example of a modification of the external operation mechanism is shown in FIG. 4 in which like or corresponding component parts are designated by the same reference numerals as those used in FIG. 2. Here, the external operating mechanism includes AND gate 26*i* and timer 26*j*. The gate circuit 28 is opened by a logic "1" level established on output line 26*j*′ of timer 26*j* when switch 26*b* is held depressed for a predetermined period of time while switch 26*c* is in the locked state. Another modification is shown in FIG. 5, in which the external operation mechanism 26 includes flip-flops 26*k*, 26*m*, AND gate 26*n* and OR gate 26*p* which are arranged such that an output signal appears on line 26*m*′ when the switch member 26*b* is depressed twice. The gate circuit 28 is opened by a logic "1" level established on line 26*m*′.

Any of the foregoing arrangements not only makes it possible to provide a battery lifetime warning display in a two-hand analog timepiece, but also makes such a display practical in view of the miniscule power consumed by the display.

Figure 6:
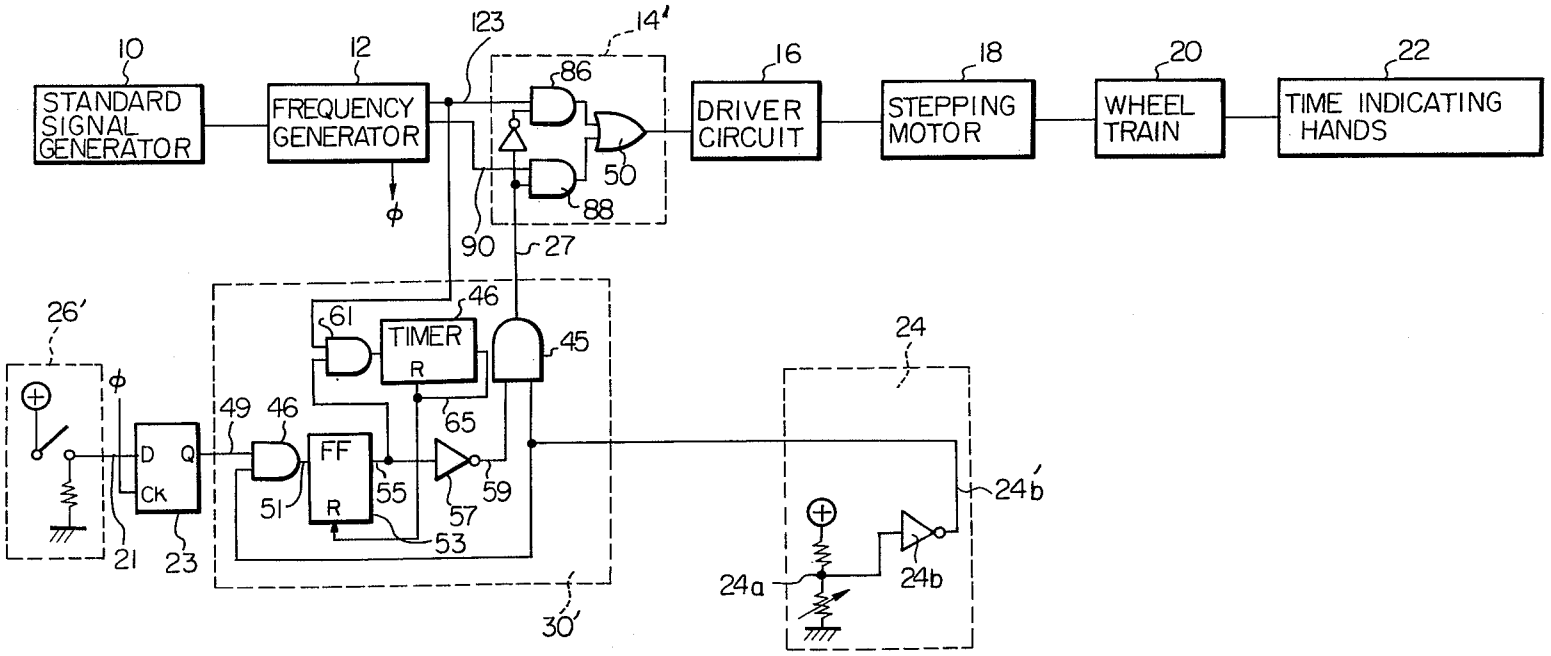
FIG. 6 is a block and logic diagram showing a modification of the electronic timepiece illustrated in FIGS. 1, 2 and 3.

A modified form of the analog electronic timepiece shown in FIGS. 1 and 2 is illustrated as a functional block diagram in FIG. 6 in which like or corresponding component parts are designated by the same reference numerals as those used in FIGS. 1 and 2. In this modification, during normal operation a 2 Hz clock signal from frequency divider 12 is transmitted over line 123 to driver circuit 16 through the enabled AND gate 86 and OR gate 50 of changeover means 14′ to drive the seconds hand of time indicating device 22 at a rate of one step per second. The battery lifetime detection mechanism 24 detects the battery voltage on line 24*a* which is normally at a high or logic "1" level. A drop in this voltage as the battery nears the end of its life is reflected by conversion to logic "0". Inverter 24*b* inverts this level and places line 24*b*′ at logic "1". Output line 27 of AND gate 45 therefore goes to logic "1" thus disenabling AND gate 86 and enabling AND gate 88. A modulating signal is now delivered from frequency divider 12 on line 90 and is coupled to driver circuit 16 so that the seconds hand of time indicating device 22 is driven at a modulated rate, advancing through 4 second graduations once every four seconds. This modulated seconds hand advance provides the battery lifetime warning indication.

If external operation mechanism 26′, composed of a single external switch member is operated during this warning indication so as to connect line 21 to logic "1", i.e., high potential side of the battery, line 49 will also go to logic "1" due to the interconnection across flip-flop 23 which is a switch bounce prevention circuit. Since line 24*b*′ is also at logic "1", AND gate 46 now opens so that its output line 51 goes to logic "1", thereby establishing a logic "1" level on the output line 55 of flip-flop 53. Inverter 57 inverts this signal, line 59 goes to logic "0", output line 27 of AND gate 45 goes to logic "0", and changeover means 14′ is restored to its original state. The seconds hand of time indicating device 22 therefore returns to its normal one step per second advance. Thus, a user confirms the altered manner of hand advance and then can restore the normal display by a single operation of the external operation mechanism 26.

Meanwhile, when line 55 is connected to logic "1" as stated above, AND gate 61 opens and permits the 2 Hz signal on line 123 to enter timer 46 whose output line 65 goes to logic "1" 24 hours later to reset itself as well as flip-flop 53. In consequence, line 55 is connected to logic "0", line 50 to logic "1", and AND gate 45 opens so that the advance of time indicating device is modulated once again. In other words, once the battery lifetime warning display has been activated it can be overcome to re-establish the normal display by operating external operation mechanism 26; however, the warning display will automatically be restored one day later. This feature serves to remind the user of the approaching end to the life of the battery.

In accordance with this modification, restoring the normal display upon confirmation of the warning display permits the timepiece to continue functioning normally until replacement of the battery. The fact that the normal display can be restored at will also permits the adoption of a warning display that is strikingly different from the normal display, a feature that makes the warning display immediately noticeable.

Although the signal for operating timer 46 was tapped off line 123, the same effect can be obtained by removing a timing signal from frequency divider 12 and using the signal to operate the timer and directly reset flip-flop 52.

Figure 7:
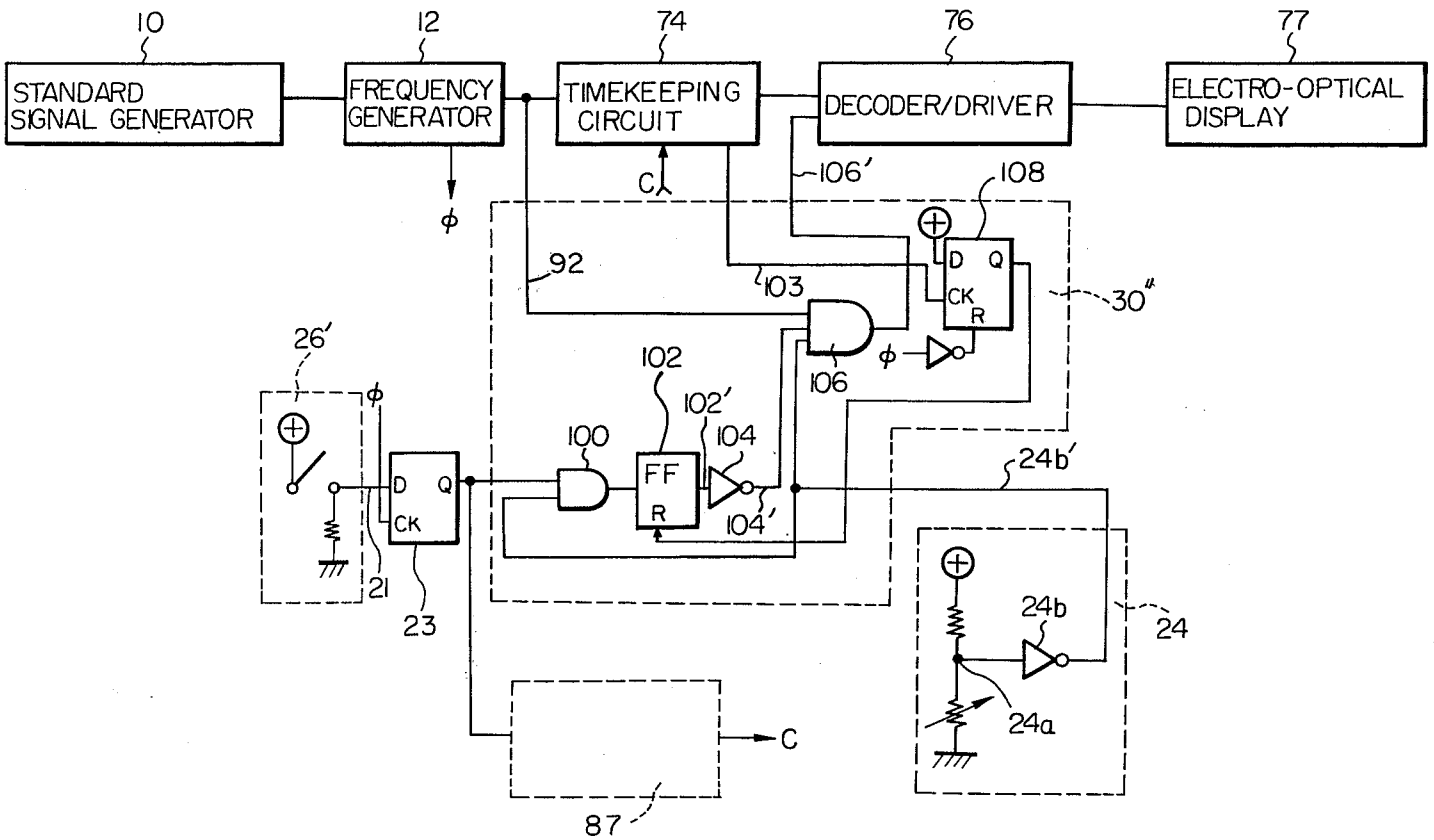
FIG. 7 is a block diagram of a modification of the electronic timepiece shown in FIG. 6.

FIG. 7 illustrates a modification of the electronic timepiece shown in FIG. 6, in which like or corresponding component parts are designated by the same reference numerals as those used in FIG. 6. This illustrated embodiment is similar in construction to that of FIG. 6 except that the timepiece employs an optical display device 77 and a decoder/driver circuit 76, in addition to a timekeeping circuit 74, a control circuit 30'', and another control circuit 87 for time corrections.

The appearance of logic "1" on line **24*b'* in response to operation of the battery lifetime detection mechanism 24 opens AND gate 10*b* so that a 1 Hz signal transmitted from frequency divider 12 over line 92 enters decoder/driver circuit 76 which modulates the display of the electro-optic display device 77 in such a manner that the display flickers once per second. This provides the warning display. If external operation mechanism 26' is now operated once, an indicative signal passes through the enabled AND gate 100 and is coupled to flip-flop 102 whose output line 102' goes from logic "0" to logic "1". This logic is inverted by inverter 104 so that line 104' goes from logic "1" to logic "0". This disenables AND gate 106 to block the transmission of the 1 Hz signal to the decoder/driver 76 and therefore stop the flickering display indicative of the battery lifetime warning. The warning display is restored after a predetermined period of time by an arrangement in which flip-flop 102 converts a timing signal, which arrives on line 103 from timekeeping circuit 74, to a narrow pulse that resets flip-flop 102 at a predetermined timing, whereupon AND gate 106** opens to restore the warning display.

The external operation mechanism 26' also serves as a setting switch to correct time data in timekeeping circuit 74. Signals corresponding to the number of switching operations are coupled to timekeeping circuit 74 as correction signals c obtained from the control circuit 87 only when a separately provided time selection switch (not shown) operates. Thus, when operating external operation mechanism 26' to stop the battery lifetime warning display, a time correction will not occur as long as the time selection switch is not operated.

The timepiece shown in FIG. 7 thus permits the warning display to be overcome but allows its restoration in a manner similar to that of the embodiment of FIG. 6. The normal display can be used until the battery is replaced, but the periodic restoration of the warning display reminds the user of the fact that the battery is approaching the ends of its life. It is of course also possible to apply this aspect of the present invention to an analog timepiece equipped with a light emitting element whose flickering state would represent the warning display. This would reduce power consumption and would be especially useful when the user does not intend to immediately replace the battery. The present invention could also be applied to an electronic timepiece with a liquid crystal display having a large-sized display element specially designed for a warning display purpose.

Figure 8:
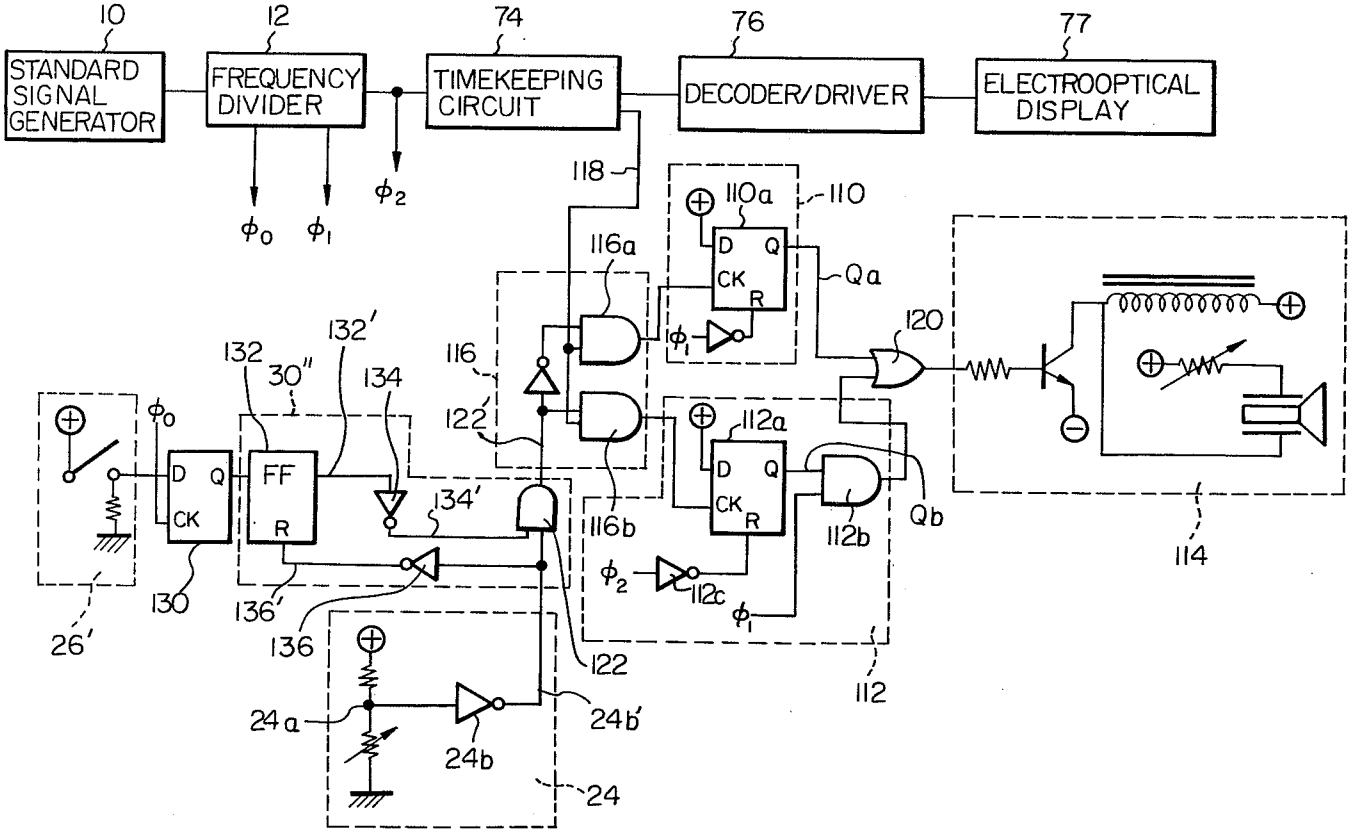
FIG. 8 is a block diagram of another embodiment of an electronic timepiece according to the present invention.
Figure 9:
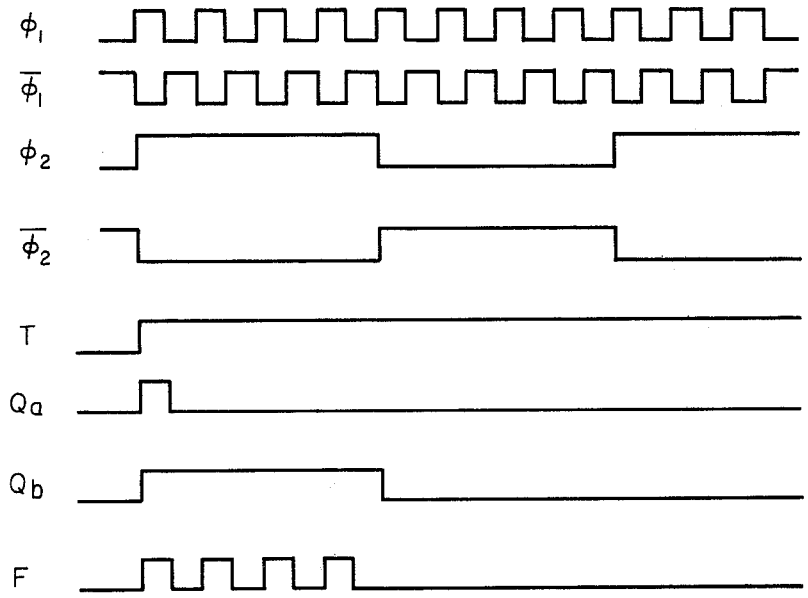
FIG. 9 illustrates timing waveforms associated with the operation of the timepiece shown in FIG. 8.

Another preferred embodiment of an electronic timepiece according to the present invention is illustrated in FIG. 8 in which like or corresponding component parts are designated by the same reference numerals as those used in FIG. 7. In this illustrated embodiment, an electronic timepiece with a digital display further comprises a signal generator 110 for an audible time tone, a signal generator 112 for an audible battery lifetime warning tone, and an audible warning tone generator 114. During normal operation, timekeeping circuit 74 applies an hours time signal (a signal delivered every hour on the hour) to switching means 116 via line 118. The signal is passed by AND gate **116*a*, to signal generator 110. As shown in FIG. 9, the hourly time signal T and a clock signal $\phi_1$ from frequency divider 12 cause flip-flop 110*a* to produce at its Q output a single pulse $Q_a$ having the same pulse width as the pulses which form the clock signal $\phi_1$. This single pulse is applied to OR gate 120 which drives warning tone generator 114 and causes it to issue a single, brief audible tone. When the battery voltage drops as the battery nears the end of its life, output line 24*b'* connected to the output side of inverter 24*b* of battery lifetime detection mechanism 24 goes from logic "0" to logic "1". AND gate 122 causes line 122' to change from logic "0" to logic "1", thereby enabling AND gate 116*b* and disenabling AND gate 116*a* of switching means 116. AND gate 116*b* thus couples hourly time signal T to signal generator 112. The signal T is then applied to the CK input of a flip-flop 112*a* which is constructed so as to be reset by a signal $\overline{Q}_2$ which is actually a signal $\overline{\phi}_2$ from the frequency divider 12 after having been inverted by inverter 112*c*. A signal $Q_b$ appears at the Q output of the flip-flop 112*a*. A signal F therefore appears at the output of AND gate 112*b*. According to the circuit of FIG. 9, the audible warning tone generator 115** is now driven to issue a brief audible tone four times.

In other words, the electronic timepiece shown in FIG. 8 is adapted to issue a single ordinary time tone every hour during normal operation but, when the fact that the battery is nearing the end of its life is detected, the single tone is replaced by four brief tones which constitute the warning indication. The advantage of this feature resides in the fact that the timepiece display can continue to function normally until the battery is replaced and yet still provide a battery lifetime warning indication without altering the visual display.

Upon confirmation of the warning tones, the timepiece can be restored to the normal operating mode as follows. A single operation of external operation mechanism 26' sends a signal through flip-flop 130 to control circuit 30''. The logic "1" on line **24*b'* indicative of a battery lifetime warning is converted to logic "0" by inverter 136. The logic "0" on line 136' releases flip-flop 132 from its reset state so that the output line 132' of the flip-flop 132 goes to logic "1". Inverter 134 inverts this level, establishing logic "0" on line 134' and closing AND gate 122. Switching means 116 is thus restored to its normal state, with AND gate 116*a* open and AND gate 116*b* closed. Now, only the single brief time tone issues from generator 114**.

It should be obvious that the warning tone could be differentiated from the normal time tone by using a higher pitch, a longer tone or a modulated tone, etc. In another alternative, an electronic timepiece equipped with an alarm could be adapted so that the time tone would be issued only when so directed by the battery lifetime warning mechanism and not during normal timepiece operation.

Figure 10:
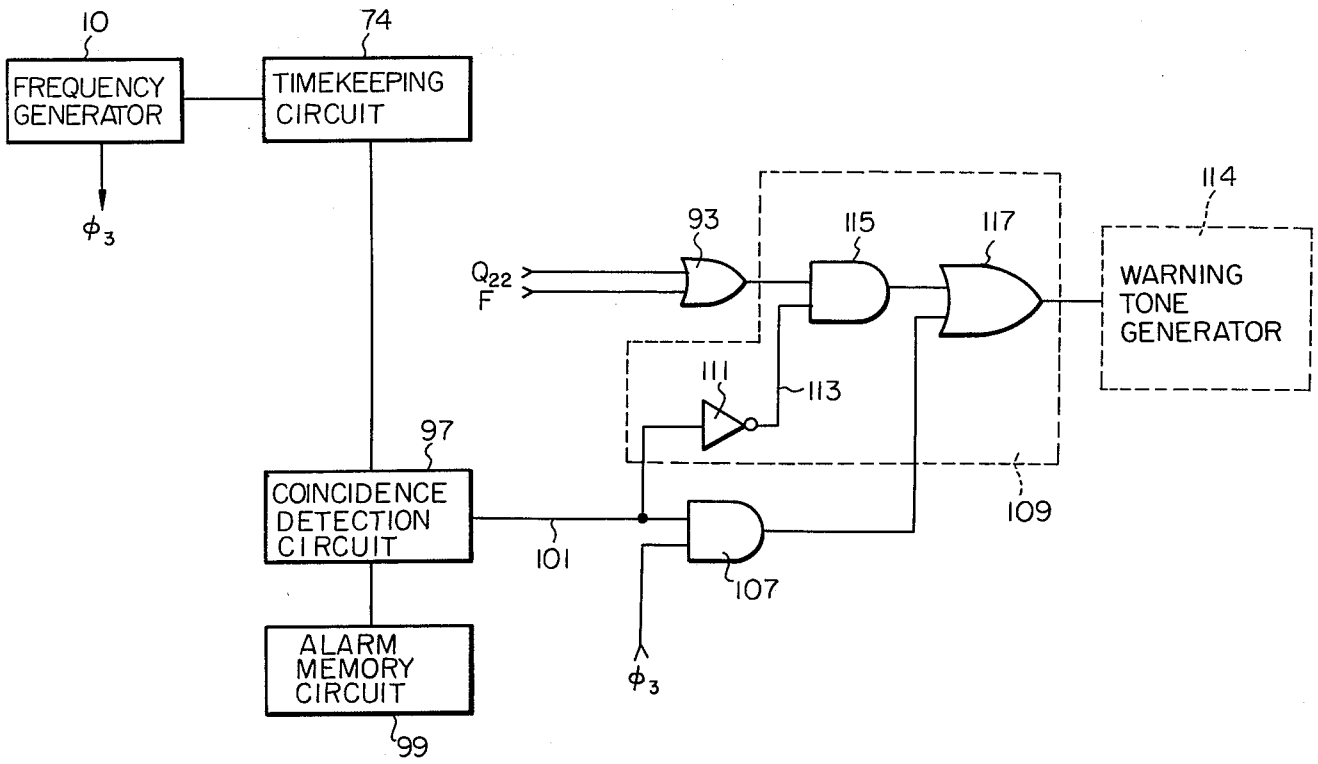
FIG. 10 is a block and logic diagram showing a modification of the electronic timepiece illustrated in FIG. 8.

A modified form of the electronic timepiece shown in FIG. 8 is shown in FIG. 10 in which like or corresponding component parts are designated by the same reference numerals as those used in FIG. 8. The electronic timepiece according to this modification further comprises an alarm memory circuit 99 and a coincidence detection circuit 97, with the warning tone generator 114 being adapted to serve also as an alarm tone generator. When the time kept in timekeeping circuit 74 coincides with the alarm time set in alarm memory circuit 99, output line 101 of coincidence detection circuit 97 goes from logic "0" to logic "1", AND gate 107 opens, and a signal $\phi_3$ from frequency divider 12 is coupled to warning tone generator 114 through OR gate 117 of gate circuit 109. The generator therefore issues an intermittent tone which indicates that the alarm time has been reached. In this arrangement, when line 101 changes from logic "0" to logic "1", an inverter 111 in gate circuit 109 causes line 113 to go from logic "1" to logic "0", thereby closing AND gate 115. As a result, when the alarm time is reached and line 101 goes to logic "1", gate circuit 109 is adapted to permit the generation of the alarm tone even if the alarm time is set to coincide with the hourly time tone. In other words, the signals indicative of the alarm tone have priority over the signals for the hourly time tone.

Thus, the embodiment of FIG. 8 and a modification thereof in FIG. 10 permit an electronic timepiece to give a battery lifetime warning indication by a change in or the absence or presence of an audible tone. A highly noticeable warning indication can thus be obtained until the battery is replaced without altering the normal visual display mode of the timepiece.

Figure 11:
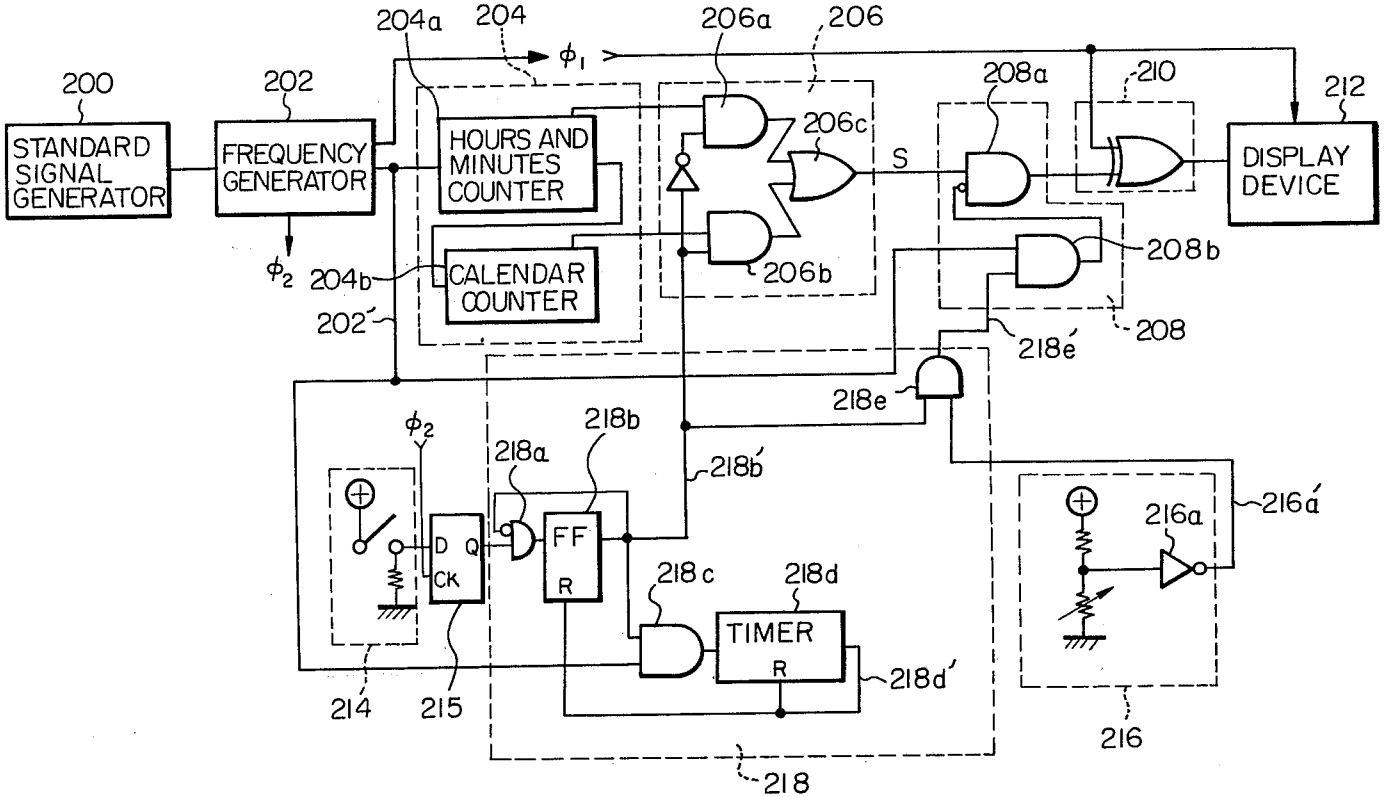
FIG. 11 is a block and logic diagram of another embodiment of an electronic timepiece according to the present invention.

FIG. 11 shows another preferred embodiment of an electronic timepiece according to the present invention. In FIG. 11, the electronic timepiece comprises a standard signal generator 200 to provide a relatively high frequency signal, a frequency divider 202 for dividing down the relatively high frequency signal to provide a relatively low time unit signal of 1 Hz, and relatively low frequency clock pulses $\phi 1$ and $\phi 2$, a timekeeping circuit 204 responsive to the time unit signal to provide current time data of, for example, hours and minutes, and calendar data, changeover circuit means 206 selectively passing one of the current time data and the calendar data from the timekeeping circuit therethrough, switching circuit means 208, a driver circuit 210, and a display device 212 adapted to provide a display of current time data and the calendar data. The timepiece further comprises an external control mechanism 214 adapted to provide a switching signal when actuated, a battery lifetime detection circuit 216 adapted to provide a detection signal when a battery voltage drops below a predetermined value, and a control circuit 218 responsive to the switching signal from the external control mechanism and the detection signal from the battery lifetime detection circuit, to provide a control signal to enable the display device 212 to provide a modulated display.

During normal operation an output on line **218*b*' of flip-flop 218*b* of control circuit 218 is at a low logic level so that AND gate 206*a* of changeover means 206 is opened and AND gate 206*b* is closed. Under this circumstance, the content of hours and minutes counter 204*a* is applied to driver circuit 210 through AND gate 206*a*, OR gate 206*c* and AND gate 208*a* and is displayed by display device 212. A single operation of external control mechanism 214 causes output of flip-flop 218*b* to go to a logic "1" level. At this instant, gate 206*a* is closed and gate 206*b* is opened so that signals from calendar counter 204*b* are now applied to driver circuit 210 for display on display device 212. The logic "1" on line 218*b*' also enables AND gate 218*c* so that the time unit signal delivered from frequency divider 202 on line 202' enters times 218*d* whose output line 218*d*' goes to logic "1" after a predetermined period of time. This resets flip-flop 218*b* and thus returns line 218*b*' to logic "0". AND gate 218*e* is opened when line 218*b*' is at logic "1". Line 216*a*' goes to logic "1" when battery lifetime detection circuit 216 detects a drop in battery voltage below a predetermined value, as previously explained. If at this time line 216*a*' is at logic "0", when display device 212 is displaying hours and minutes time data, AND gate 218*e* is closed so that the signal from the detection circuit 216 does not affect the display. If, in this case, external control mechanism 214 is actuated, the output of flip-flop 218*b* goes to logic "1" level and, so, the AND gate 218*e* is opened. Therefore, line 218*e*' goes from logic "0" to logic "1", thus enabling AND gate 208*b*. At 1 Hz time unit signal delivered by frequency divider 202 on line 202' therefore enters AND gate 208*a* so that the calendar display flickers once per second as viewed on display device 212**.

More specifically, when the timepiece shown in FIG. 11 is in the normal time display mode to provide a display of hours and minutes data, the display remains unaffected even if battery lifetime detection circuit 216 produces a detection signal. The battery lifetime warning display will appear only upon operating a switch 214. In this case, the warning display will appear only when the timepiece is in the calendar mode. Thus, although the normal time display mode remains unaffected by a detection signal, the warning display will appear by switching to another specific frequently used function thereby to remind the user of the battery condition.

The foregoing embodiment thus provides another method of presenting a battery lifetime warning display without altering the normal time display. The display mode which is modulated to provide the warning display is of course not limited to the calendar mode; any frequently used display mode will suffice, as will any external operation member that is capable of establishing the desired mode.

Figure 12:
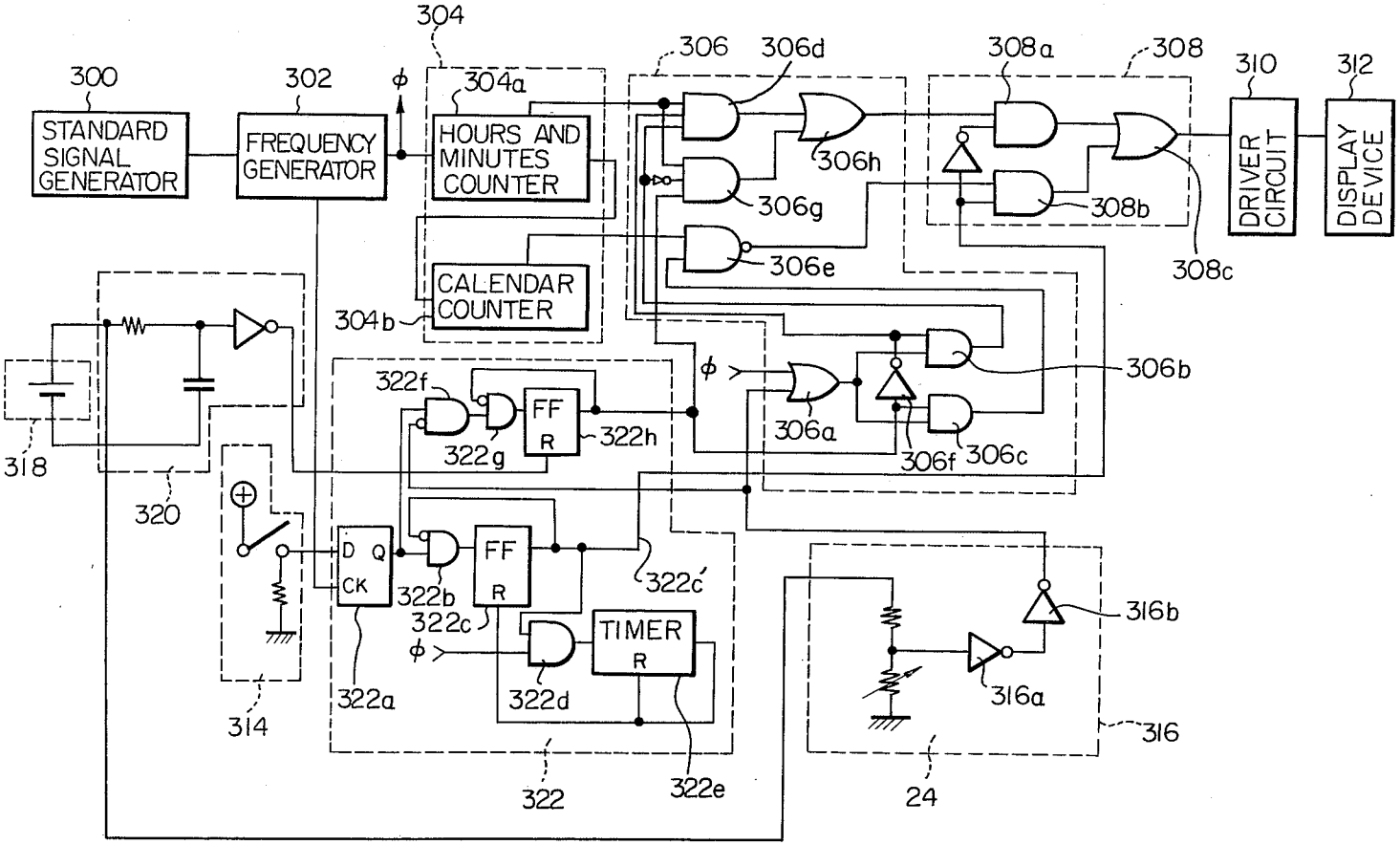
FIG. 12 is a block and logic diagram of another embodiment of an electronic timepiece according to the present invention.

FIG. 12 shows still another preferred embodiment of an electronic timepiece according to the present invention. In FIG. 12, the electronic timepiece comprises a standard signal generator 300 to provide a relatively high frequency signal, a frequency divider 302 for dividing down the relatively high frequency signal to provide a relatively low time unit signal of 1 Hz, and relatively low frequency clock pulse $\phi$, a timekeeping circuit 304 responsive to the time unit signal to provide current time data of, for example, hours and minutes, and calendar data, changeover circuit means 306 selectively passing one of the current time data and the calendar data from the timekeeping circuit therethrough, switching circuit means 308, a driver circuit 310, and a display device 312 adapted to provide a display of current time data and the calendar data. The timepiece further comprises an external control mechanism 314 adapted to provide a switching signal when actuated, a battery lifetime detection circuit 316 adapted to provide a detection signal when a battery voltage drops below a predetermined value, a battery 318, a pulse generation circuit 320, and a control circuit 322 responsive to the switching signal from the external control mechanism and the detection signal from the battery lifetime detection circuit, to provide a control signal to enable the display device 212 to provide a modulated display.

When a battery voltage drops below a predetermined value, an output of inverter 316*a* goes to logic "1" so that an output of inverter 316*b* goes to logic "0". A clock signal $\phi$ passes through OR gate 306*a* and is applied through AND gate 306*b* to AND gate 306*d*. Since AND gate 306*d* is gated by the clock signal $\phi$, time signals obtained from hours and minutes counter 304*a* are controlled by the AND gate 306*d* and transmitted through switching means 308 and applied to driver circuit 310 so that the hours and minutes display is caused to flicker on display device 312. If the signal $\phi$ is a 1 Hz clock signal the display will flash once per second.

If external operation mechanism 314 is operated once while the output of inverter 316*b* is at logic "0", an output of flip-flop 322*a* goes to logic "1" and an output of AND gate 322*b* goes to logic "1" so that an output flip-flop 322*c* goes to logic "1". The output of flip-flop 322*c* is applied through line 322*c'* to switching means 308. Therefore, AND gate 308*a* is closed while AND gate 308*b* is opened to permit calendar data from calendar counter 304*b* to driver circuit 310 which causes display device 312 to provide a display of calendar data. In this case, AND gate 322*d* is enabled by the output of flip-flop 322*c*, allowing the clock signal $\phi$ to enter timer 322*e*. As a result, the calendar display will continue until the output of flip-flop 322*c* returns to logic "0" which occurs when flip-flop 322*c* is reset due to a change from logic "0" to logic "1" of the output of timer 322*e*. Meanwhile, since AND gate 322*f* is enabled by the logic "0" on the output of inverter 316*b*, the switching signal produced by external operation mechanism 314 is also applied to flip-flop 322*h* whose output goes from logic "0" to logic "1". This output is applied to inverter 306*f* so that AND gates 306*b* and 306*d* are closed and AND gates 306*c* and 306*g* are opened. The clock signal $\phi$ is now applied to AND gate 306*e*. Accordingly, the calendar information being displayed on display device 312 now begins to flicker. When the output of flip-flop 322*c* goes to "0" logic level in response to the output of timer 322*e*, the And gate 308*b* is closed and the AND gate 308 is opened. In this case, the current time data passed through the AND gate 306*g* and OR gate 306*h* is passed through the AND gate 308*a* to the driver circuit 310 so that the display device 312 provides a display of current time in a normal mode.

The logic "1" on the output of flip-flop 322*h* will continue until flip-flop 322*h* is reset by a pulse which is generated by pulse generating circuit 320 when battery 318 is replaced by a new battery. As long as the output of flip-flop 322*h* is at the logic "1" level no input signals can be applied to flip-flop 322*h* since gate 322*g* is disenabled.

More specifically, initially AND gate 306*d* is open in response to a detection signal from battery lifetime detection mechanism 316 so that the hours and minutes display begins to flicker, this providing the warning display. Next, upon a single operation of external operation mechanism 314, AND gate 306*e* is opened instead of AND gate 306*d* so that the calendar display begins to flicker to give the warning indication. In other words, the warning display is transferred from the time display mode to the calendar display mode. This condition will continue until the battery is replaced by a new one. The calendar display will therefore flicker whenever external operation mechanism 26 is subsequently operated to establish the calendar mode.

With this arrangement, the user can transfer the flickering warning display, which first appears in the normal time display mode, to the calendar display mode by operating the external operation mechanism 314. Upon doing so, the normal time display of hours and minutes can be restored to its usual state which will no longer be affected by the detection mechanism 316. However, whenever the calendar mode is established the flickering warning display will reappear in the calendar mode to remind the user of the battery condition.

Although the embodiment of FIG. 12 has been described with respect to a battery lifetime warning mechanism as an additional timepiece mechanism with information indicative of a battery lifetime warning being transferred from the normal time display mode to another mode, the present embodiment is not limitative since the present invention can be applied to any case in which information from an optional timepiece function is transferred from the normal time display mode to another display mode.

Figure 13:
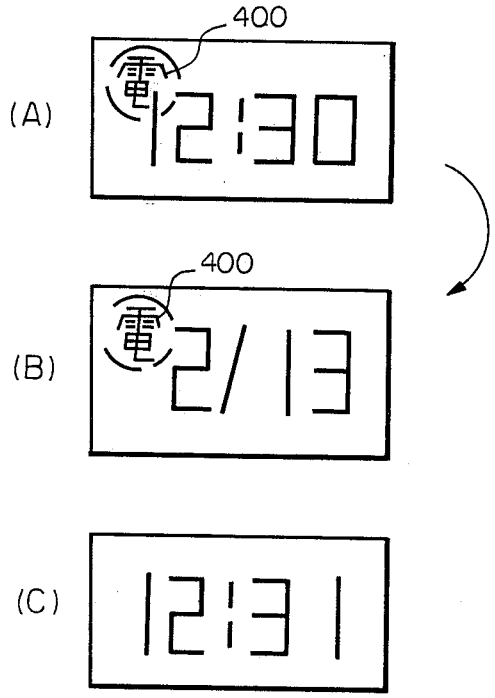
FIGS. 13A, B and C are useful for explaining an example of a battery lifetime warning display produced by the timepiece shown in FIG. 12.

An example of how a battery lifetime warning display can be accomplished is illustrated in FIG. 13. FIG. 13(A) shows a normal time display mode in which the time displayed is 12:30. Initially, a battery lifetime warning mark 400 is displayed in the normal time display mode but is transferred to and displayed in the calendar display mode shown in FIG. 13(B) when an external operation switch (not shown) is operated to establish the calendar mode. Here, the calendar mode display a date of February 13. The warning mark 400 upon its transfer to the calendar mode is erased from the normal time display mode, as can be seen in FIG. 13(C). A large and therefore easily noticeable warning mark is thus initially displayed in the normal time display mode but, because it would detract from the appearance of the time display until replacement of the battery, it is possible to transfer the warning mark to the calendar mode where it will be visible whenever the calendar mode is established. The user will therefore be reminded of the battery condition whenever he switches to the calendar.

In accordance with the present invention, an electronic timepiece having a battery lifetime detection mechanism produces a battery lifetime warning display that appears in the normal time display mode only temporarily or which can be transferred to and made to appear permanently in another display mode, or which can take the form of a distinctive audible tone. Thus, the electronic timepiece of the present invention makes it possible to indicate that a battery is nearing the end of its life without permanently disrupting the normal display mode or consuming excessive power.

While the present invention has been shown and described with reference to particular embodiments, it should be noted that other various changes or modifications may be made without departing from the scope of the present invention.

What is claimed is:

1. An electronic timepiece powered by a battery, comprising:

means for generating a relatively high frequency signal;

means for providing a time unit signal in response to the relatively high frequency signal;

a driver circuit responsive to the time unit signal to produce first driving pulses;

a stepping motor operative in response to the first driving pulses;

time indicating hand means driven in a normal mode by the stepping motor to provide a display of time data;

external operation means adapted to provide a switching signal when actuated;

battery lifetime detection means adapted to provide a detection signal when a battery voltage drops below a predetermined value;

gate means responsive to the switching signal and the detection signal to provide an output signal; and means responsive to the output signal for causing the driver circuit to produce second driving pulses to actuate the stepping motor such that the time indicating hand means is driven in a mode different from the normal mode to provide a display of a battery lifetime warning only when the external operation means is actuated in the presence of the detection signal.

2. In an electronic timepiece powered by a battery and having a standard signal generator, a frequency divider providing a time unit signal and a clock signal higher in frequency than the time unit signal in response to a relatively low frequency signal from the standard signal generator, a driver circuit responsive to the time unit signal to provide first driving pulses, a reversible stepping motor responsive to the first driving pulses to rotate in a normal direction, a wheel train and time indicating hands driven by the stepping motor through the stepping motor to rotate in the normal direction to provide a display of time data, the improvement comprising:

changeover means normally passing the time unit signal to the driver circuit;

external operation means adapted to produce a switching signal when actuated;

battery lifetime detection means adapted to produce a detection signal when a battery voltage drops below a predetermined value; and gate means responsive to the switching signal and the detection signal to provide an output signal;

a control circuit responsive to the output signal from the gate means to generate the first control signal and a second control signal;

said changeover means including means responsive to the first control signal to pass the clock signal to the driver circuit; and clockwise/counter-clockwise switching means being responsive to the second control signal from the control circuit and cooperating with the driver circuit;

whereby the driver circuit generates second driving pulses in response to the clock signal so that the stepping motor rotates in an opposite direction so that the time indicating hands are rotated in a reverse direction at a higher than normal speed to provide a display of a battery lifetime warning.

3. In an electronic timepiece powered by a battery and having a display device to display time data comprising:

battery lifetime detection means adapted to produce a detection signal when a battery voltage drops below a predetermined value;

means for providing a battery lifetime warning indication in response to said detection signal;

external operation means adapted to provide a switching signal when actuated; and control circuit means responsive to said switching signal for thereby disenabling said battery lifetime warning indication providing means.

4. The improvement according to claim 3, in which said timepiece includes means for generating a relatively high frequency signal, and a frequency divider for producing a time unit signal in response to said relatively high frequency signal, said control circuit means being controlled by said time unit signal so as to release the disenabling function of said control circuit means.

5. The improvement according to claim 4, in which said control circuit means includes a timer responsive to said time unit signal to automatically enable said battery lifetime warning indication providing means at a predetermined time instant after it has been disenabled by said control circuit means.

6. In an electronic timepiece powered by a battery, the improvement comprising:

external operation means comprising at least two switching members adapted to produce a switching signal when said at least two switching members are simultaneously actuated;

battery lifetime detection means adapted to produce a detection signal when a battery voltage drops below a predetermined value;

means for providing a battery lifetime warning indication; and means for rendering said battery lifetime warning indication providing means operative only when said switching signal is produced in the presence of said detection signal.

7. The improvement according to claim 6, in which said electronic timepiece has time indicating hands to provide a display of time data in a normal mode, and in which said battery lifetime warning indication providing means comprises said time indicating hands, with the hands being adapted to be driven in a mode different from said normal mode by said rendering means to provide said battery lifetime warning indication.

8. The improvement according to claim 7, in which said time indicating hands are rotated clockwise and counter-clockwise at a higher than normal speed by said rendering means, with a combination of clockwise and counter-clockwise rotation of said time indicating hands providing said battery lifetime warning indication.

9. The improvement according to claim 8, in which said rendering means includes means for causing said time indicating hands to provide said battery lifetime warning indication for a predetermined time interval and automatically returning said time indicating hands to its normal mode after said predetermined time interval has elapsed.

10. In an electronic timepiece powered by a battery, the improvement comprising:

external operation means including a switch member and counter means adapted to produce a switching signal when said switch member is actuated a predetermined number of times;

battery lifetime detection means adapted to produce a detection signal when a battery voltage drops below a predetermined value;

means for providing a battery lifetime warning indication; and means for rendering said battery lifetime warning indication providing means operative only when said switching signal is produced in the presence of said detection signal.

11. The improvement according to claim 10, in which said electronic timepiece has time indicating hands to provide a display of time data in a normal mode, and in which said battery lifetime warning indication providing means comprises said time indicating hands, with the hands being adapted to be driven in a mode different from said normal mode by said rendering means to provide said battery lifetime warning indication.

12. The improvement according to claim 11, in which said time indicating hands are rotated clockwise and counter-clockwise at a higher than normal speed by said rendering means, with a combination of clockwise and counter-clockwise rotation of said time indicating hands providing said battery lifetime warning indication.

13. The improvement according to claim 12, in which said rendering means includes means for causing said time indicating hands to provide said battery lifetime warning indication for a predetermined time interval and automatically returning said time indicating hands to its normal mode after said predetermined time interval has elapsed.

14. In an electronic timepiece powered by a battery and having time indicating hands to provide a display of time data in a normal mode, the improvement comprising:

external operation means adapted to produce a switching signal when actuated;

battery lifetime detection means adapted to produce a detection signal when a battery voltage drops below a predetermined value;

means for providing a battery lifetime warning indication; and means for rendering said battery lifetime warning indication providing means operative only when said switching signal is produced in the presence of said detection signal;

said battery lifetime warning indication providing means comprising said time indicating hands, with the hands being adapted to be driven in a mode different from said normal mode by said rendering means to provide said battery lifetime warning indication.

15. The improvement according to claim 14, in which said time indicating hands are rotated clockwise and counter-clockwise at a higher than normal speed by said rendering means, with a combination of clockwise and counter clockwise rotation of said time indicating hands providing said battery lifetime warning indication.

16. The improvement according to claim 15, in which said rendering means includes means for causing said time indicating hands to provide said battery lifetime warning indication for a predetermined time interval and automatically returning said time indicating hands to its normal mode after said predetermined time interval has elapsed.

17. In an electronic timepiece powered by a battery and having means for providing a relatively high frequency signal, a frequency divider for providing a time unit signal in response to the relatively high frequency signal, a timekeeping circuit responsive to the time unit signal to provide time information signals, and a display device to provide a display of time information in response to the time information signal, the improvement comprising:

battery lifetime detection means adapted to produce a detection signal when a battery voltage drops below a predetermined value;

switching means coupled to receive said time information signals and said detection signal and having first and second output terminals, said switching means providing said time information signals at one of said first and second terminals which is selected by means of said detection signal;

signal generation circuit means including a first signal generator responsive to said time information signal from the first output terminal of said switching means for generating a battery lifetime warning signal, and a second signal generator responsive to said time information signal from the second output terminal of said switching means for generating a time tone signal indicative of said time information; and audible warning tone generation means responsive to said warning signal for generating an audible warning tone indicative of said battery dropping below said predetermined value, said audible warning tone generation means being responsive in said time tone signal to provide an audible time tone at a predetermined time instant determined by said time information signals.

18. The improvement according to claim 17, further comprising external operation means to provide a switching signal when actuated, and means for disenable said switching means to provide said time information signals at the first output terminal in response to said switching signal.

* * * * *